United States Patent [19]

Tommerson et al.

[11] Patent Number: 4,927,366

[45] Date of Patent: May 22, 1990

[54] FUSED ELECTRICAL CONNECTOR WITH SEWING WINGS

[75] Inventors: David P. Tommerson; Kevin L. Brekkestran, both of Fargo, N. Dak.

[73] Assignee: Environwear, Inc., Fargo, N. Dak.

[21] Appl. No.: 404,887

[22] Filed: Sep. 8, 1989

[51] Int. Cl.[5] ..... H01R 13/68; H01R 13/58

[52] U.S. Cl. ..... 439/37; 439/622; 439/460; 219/517

[58] Field of Search ..... 439/621, 622, 460, 449, 439/37; 337/197, 198; 219/517

[56] References Cited

U.S. PATENT DOCUMENTS

| | | | |
|---|---|---|---|
| 710,429 | 10/1902 | Collins et al. | 128/385 |
| 1,963,990 | 6/1934 | Gilkeson et al. . | |
| 2,299,162 | 10/1942 | Marick . | |
| 2,329,766 | 9/1943 | Jacobsen | 128/399 |
| 2,579,383 | 12/1951 | Goudsmit | 128/379 |
| 2,584,302 | 2/1952 | Stein | 128/379 |
| 2,845,519 | 7/1958 | Willat | 219/517 |
| 2,850,712 | 9/1958 | Franklin | 439/460 |
| 3,084,241 | 4/1963 | Carrona | 219/211 |
| 3,423,567 | 1/1969 | Mills | 219/517 |
| 3,858,028 | 12/1974 | Kerr . | |
| 4,042,803 | 8/1977 | Bickford . | |
| 4,404,460 | 9/1983 | Kerr . | |
| 4,406,512 | 9/1983 | Schell | 439/460 |
| 4,768,979 | 9/1988 | Wu | 439/622 |

FOREIGN PATENT DOCUMENTS

| | | | |
|---|---|---|---|
| 1276855 | 10/1961 | France | 439/460 |

*Primary Examiner*—Gary F. Paumen

*Attorney, Agent, or Firm*—Harness, Dickey & Pierce

[57] ABSTRACT

An electrical connector assembly adapted to be securely attached to a portion of an electrically heated garment for allowing electrical current to be supplied through the connector assembly to at least one heating wire in the garment. In a preferred embodiment the connector assembly includes: a removable male plug for securely receiving a portion of a conductor; a female receptacle for securely receiving a portion of at least one heating wire of the garment and removably connecting with the male plug in a mating fashion, thereby electrically connecting the conductor and the heating wire; and a plurality of sewing wings integrally formed with the female receptacle and protruding outwardly therefrom for facilitating quick, easy and secure attachment of the receptacle to the garment by way of a sewing machine. In one configuration, the connector assembly is also adapted to house therein a removable fuse for providing further safety protection to a wearer of the garment.

16 Claims, 3 Drawing Sheets

FUSED ELECTRICAL CONNECTOR WITH SEWING WINGS

CROSS-REFERENCE TO RELATED APPLICATIONS

The present invention is related to the subject matter of the following co-pending applications, filed concurrently herewith:

"Electronic Control System and Method For Cold Weather Garment", application Ser. No. 405,626;

"Hybrid Electronic Control System and Method For Cold Weather Garment", application Ser. No. 405,142;

"Electrically Heated Form-Fitting Fabric Assembly", application Ser. No. 404,827; and "Electrically Heated Garment", application Ser. No. 405,627.

The disclosures of all of the applications cited above are hereby incorporated by reference and made a part hereof the same as if fully set forth herein.

BACKGROUND OF THE INVENTION

1. Technical Field

This invention relates to small, low power electrical connector assemblies and particularly to fused electrical connector assemblies adapted for use in electrically heated garments.

2. Description

Small, low power electrical connector assemblies are used in a wide variety of applications. One type of application is with electrically heated garments or outerwear. Such connector assemblies are useful for supplying electrical power to a plurality of different areas, or zones, of such a garment and permitting different areas of the garment to be disconnected from use if it is so desired. Examples of garments using various forms of electrical connectors are illustrated and discussed in the following U.S. patents:

| U.S. Pat. No. | Issued | Inventor(s) |
|---|---|---|
| 710,429 | 1902 | P. Collins et al. |
| 2,329,766 | 1943 | W. Jacobsen |
| 2,579,383 | 1951 | F. Goudsmit |
| 3,084,241 | 1963 | G. Carrona |

Although the connectors disclosed in the above-mentioned U.S. patents provide varying degrees of effectiveness for supplying electrical power to various, independent heating elements of a heated garment, it would nevertheless be desirable both from manufacturing and operability standpoints to have an electrical connector adaptable for use in a heated garment which is readily and easily attachable to the garment material itself, and which also is operable to interrupt current flowing to selected heating elements within the garment.

More specifically, it would be both helpful and cost effective from a manufacturing standpoint if such an electrical connector included means integrally formed with a portion of the connector assembly which would allow the connector to be quickly and easily attached to the fabric of the garment.

From an operations standpoint, it would also be desirable if such a connector for an electrical garment included its own fuse. This could help reduce the chance of shock hazard if the heating element associated with the connector assembly should short out, thereby possibly producing an over-current situation for that particular heating element. Also, if individual heating zones of a garment were separately fused, this would help minimize the impact of short circuit conditions in one zone adversely affecting other zones which are still in operating condition. Thus, it would be useful to provide a connector that included a fuse. It would also be advantageous if the fuse was readily removable and easily replaced in the connector assembly.

It is therefore a principal object of the present invention to provide a connector assembly having wing-like portions capable of being sewably attached by a sewing machine or the like to the fabric of an electrically heated garment.

It is a further object of the present invention to provide an electrical connector assembly having a self-contained fuse, with the fuse being capable of quick and easy replacement by the wearer of an electrically heated garment.

It is a further object of the present invention to provide an electrical connector assembly capable of being quickly and easily disconnected by the wearer of an electrically heated garment to thereby selectively enable and disable selected heating elements of the garment.

It is a further object of the present invention to provide a connector assembly having integrally formed, wing-like portions adapted to facilitate quick and easy attachment to the garment such as by sewing.

SUMMARY OF THE INVENTION

The above-stated objects, along with other advantages and features, are fulfilled by a fused electrical connector assembly with sewing wings of the present invention. This connector assembly is adapted to be securely attached, preferably by machine-sewn stitches, to a portion of fabric of an electrically heated garment. Electric current is supplied through an easily replaced fuse in the connector assembly to at least one heating wire of the garment. In a preferred embodiment the connector assembly comprises removable male plug means having first and second ends for securely receiving a portion of a conductor in the first end; receptacle means having first and second ends for securely receiving a portion of at least one heating wire in its second end and removably receiving the plug means in a mating fashion in a portion of its first end, thereby electrically connecting the conductor and the heating wire; and wing means securely attached to the receptacle means and protruding outwardly therefrom for facilitating quick, easy and secure attachment of the receptacle means to the garment. In this preferred embodiment, the wing means are particularly well-adapted, on account of the configuration and thickness of same, to be sewn by machine to the fabric of the garment.

BRIEF DESCRIPTION OF THE DRAWINGS

The various advantages of the present invention will become apparent to one skilled in the art upon reading the following specification and subjoined claims, and by reference to the drawings in which:

DETAILED DESCRIPTION OF THE PREFERRED EMBODIMENTS

Figure 1:
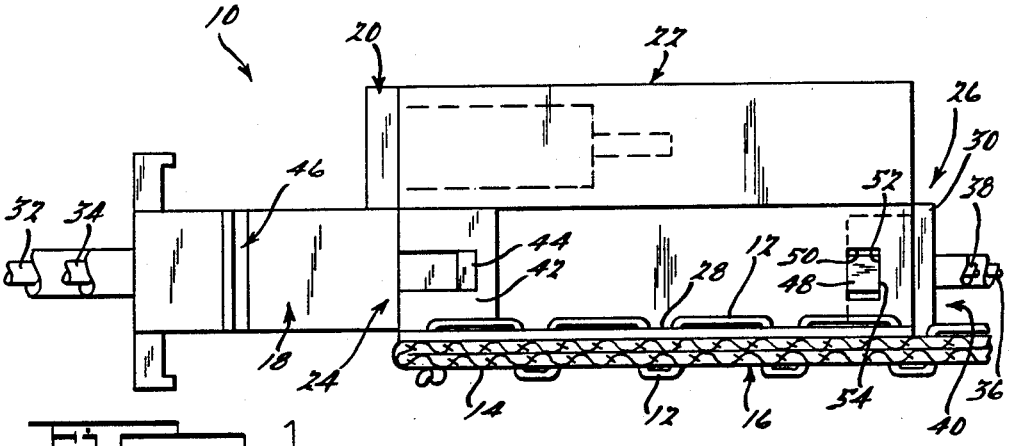
FIG. 1 is a side elevational view of the connector assembly in assembled form sewably attached by sewing thread or the like to a portion of fabric of an electrically heated garment.

In FIG. 1 there is shown a view of the connector assembly 10 stitched by thread 12 to the fabric 14 of an electrically heated garment 16. The connector assembly 10 generally comprises a removable (i.e., disconnectable) male connector or plug 18, a removable fuse 20, a female connector or receptacle 22 having front and rear ends 24 and 26 respectively, a plurality of thin, flat sewing wings 28 (of which only one is visible in FIG. 1) integrally formed with the receptacle 22, and a strain relief member 30. Also shown are a plurality of conductors 32 and 34 securely attached to the male plug 18 for supplying electrical power to the plug 18 from a power supply (not shown). First and second portions 36 and 38 of an electrical resistance heating wire 40 are also shown attached to the rear end 26 of the receptacle 22 for generating heat in a particular area, or zone, of the electrically heated garment 16.

The conductors 32 and 34 will preferably also include a flexible insulating jacket, such as any commercially available polymer. The heating wire 40 will also have an insulating jacket preferably made from a fluoropolymer resin or like compound to provide sufficient insulation of the heating wire 40 while still allowing the heating wire to be flexed during wearing of the garment. The heating wire 40 itself will preferably be able to handle about one to twenty amps of current. Specific details of a preferred heating wire and preferred insulating materials therefor are disclosed in the aforementioned patent application, Ser. No. 404,827 (Attorney Docket No. 0589-00004).

The plug 18 is adapted to be removably inserted into the receptacle 22, which acts as a housing, and is held securely to the receptacle 22, once inserted, by two locking tabs 42 integrally formed with and on opposite sides of the plug 18. Each locking tab 42 is designed to work in cooperation with a wedge-shaped locking shoulder portion 44 integrally formed with the receptacle 22 and having a complementary configuration. For this reason, the plug 18 can be lockably secured in a snap-like fashion to the receptacle 22 when the locking tabs 42 are slidably urged over their respective mating shoulder portions 44 during insertion of the plug 18 into the receptacle 22. As may be best understood by reviewing FIGS. 1, 2 and 4 together, pressing inwardly on end portion 46 of the locking tab 42 causes the other end portion 47 to clear shoulder portion 44 when the plug 18 is slidably removed from the receptacle 22.

Figure 4:
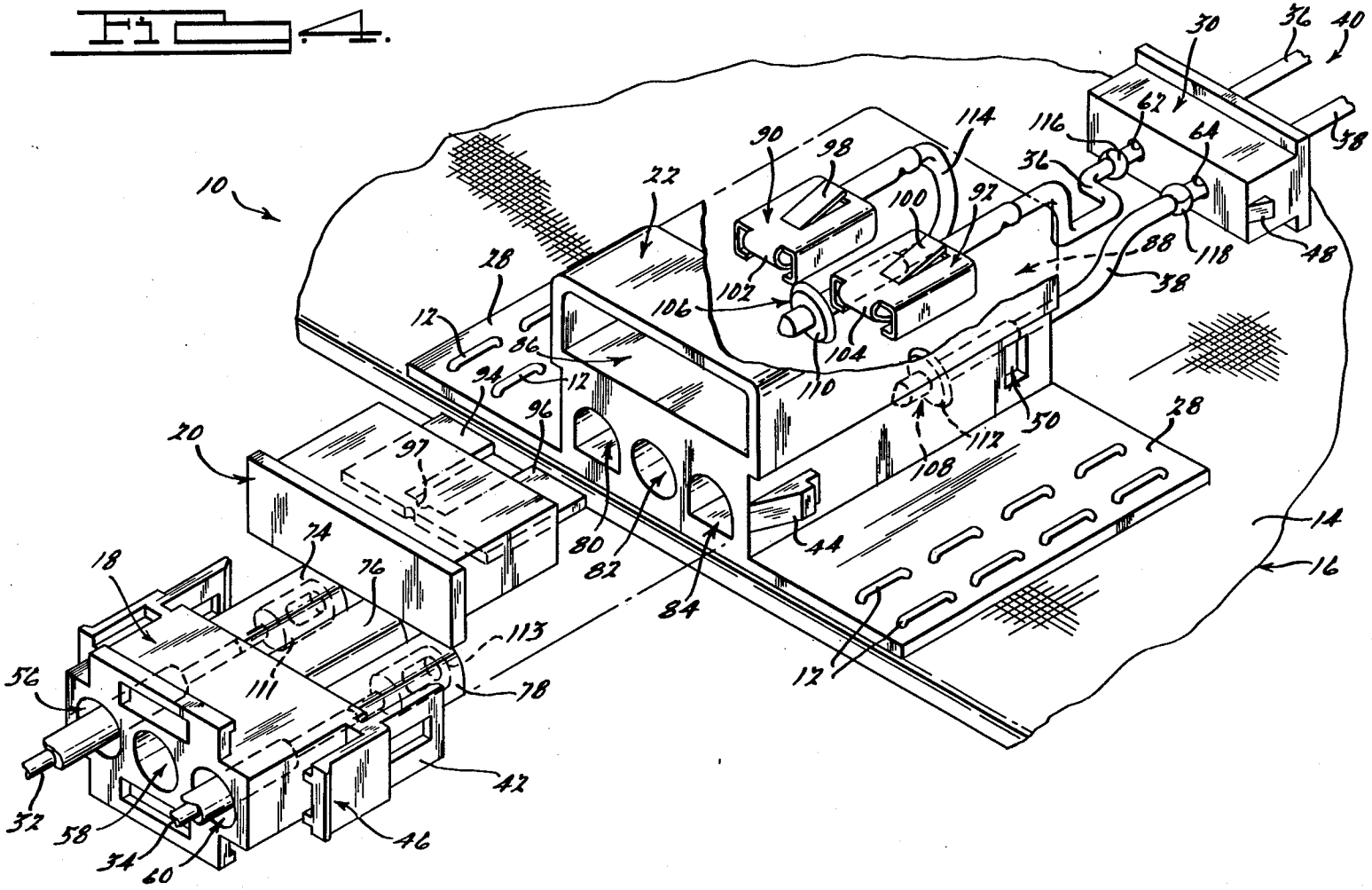
FIG. 4 is an exploded perspective view of the FIG. 1 connector assembly with the top rear portion of the female connector partially removed to show more clearly the internal wiring, terminal lugs and terminal posts included therein.

As may be best understood by reference to FIGS. 1 and 4, the strain relief member 30 is also removably secured to the receptacle 22 by a similar wedge-shaped locking shoulder 48 and cut-out 50 arrangement. As the strain-relief member 30 is slidably inserted into the rear end 26 of the receptacle 22, the rear edge 52 of locking shoulder 48 will engage with an edge 54 of rectangular cut-out hole 50, thereby holding the strain relief member 30 securely therein. Prying outwardly on the inside edges of the rear end 26 with a small tool, such as a screwdriver having a small, flat blade, while simultaneously pulling outwardly on the strain relief member 30, will allow the strain relief member 30 to be removed from the receptacle 22. It should also be understood that while only a single locking tab 42 and shoulder portion 44, a single locking shoulder 48 and cut-out 50, and a single sewing wing 28 may be illustrated in FIGS. 1 and 4, like locking arrangements and a like sewing wing are also included on the hidden side of the receptacle 22, and may in fact be at least partially shown in the following figures.

The plug 18, receptacle 22, and the strain relief member 30 are all made, preferably by injection molding, from a fairly rigid and inexpensive electrically insulating material, preferably "Zytel 101", a nylon-like material commercially available from the DuPont Corporation. It should be understood, however, that a wide variety of insulating materials may be employed in the construction of elements 18, 22 and 30 of the connector assembly 10, and that Zytel 101 has been chosen as the preferred material of construction because of its combination of strength, durability, its relatively easy manufacturability by injection molding, and its relatively low cost.

Figure 2:
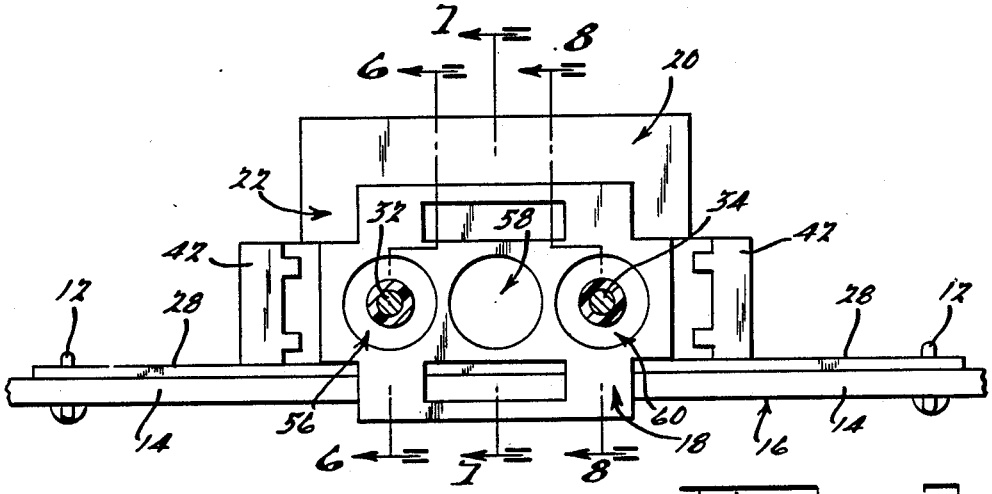
FIG. 2 is a front view of the FIG. 1 connector assembly.

In FIG. 2 there is shown a front view of the connector assembly 10 with the male plug 18 inserted in the receptacle 22. In FIG. 2 it can be seen that the male plug 18 comprises a plurality of apertured portions 56, 58 and 60, of which only the two outer apertured portions 56 and 60 are actually used to carry the conductors 32 and 34. FIG. 2 also shows more clearly the outwardly extending orientation and substantially planar configuration of the sewing wings 28, and how they rest flushly against the fabric 14 of the garment 16, thereby holding the receptacle 22 flush against the fabric 14 when they are sewn or attached in a like manner to the fabric 14. Also, the apertures 56 and 60 may be filled with a moisture and heat resistant glue 61, preferably "Jet-Melt", a potting compound commercially available from the 3M Corporation of St. Paul, Minn., under part number 3796-TC, or other like potting compound to help provide a protective strain relief function for the conductors 34 and 36 after they are inserted into apertures 56 and 60. This provides additional ruggedness and durability from the point of view of the wearer of the garment because the conductors 32 and 34 will be less likely to be accidentally pulled out of the plug 18 during wearing of the garment 16.

Figure 3:
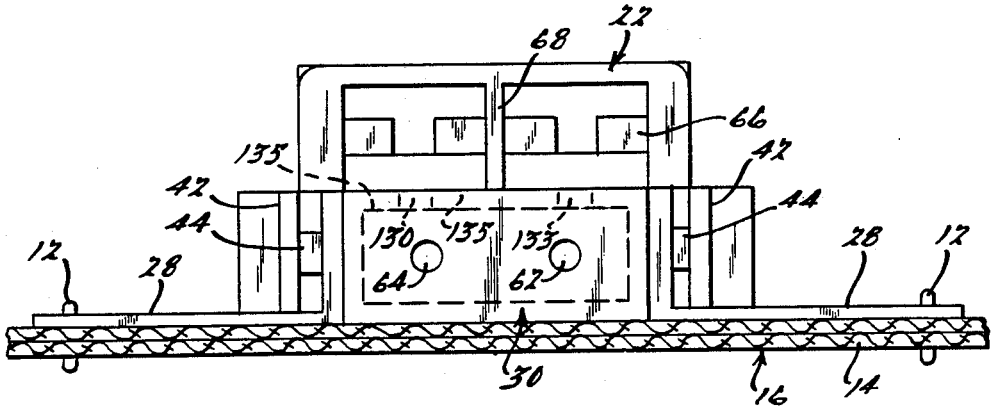
FIG. 3 is a rear view of the FIG. 1 connector assembly without the wires passing through, but otherwise showing the strain relief member inserted into a rear cavity portion of a female receptacle of the connector assembly.

In FIG. 3 there is shown a rear view of the connector assembly 10, without wires 36 and 38, but with the strain relief member 30 securely inserted into the receptacle 22. From FIG. 3 it can be seen more clearly that the strain relief member 30 has a generally rectangular configuration and includes a plurality of apertures 62 and 64 for allowing passage of the first and second portions 36 and 38 (not shown) respectively of the heating wire 40 of the garment 16 therethrough and into the receptacle 22. The strain relief member 30 functions to reduce the stress and strain on the heating wire 40 where the heating wire 40 attaches to electrical terminals (shown clearly in FIG. 4) inside the receptacle 22, especially when the heating wire 40 is pulled taut or otherwise stretched during wearing of the garment 16. For even further durability, the apertures 62 and 64 could be filled with a heat and moisture resistant glue 61, such as Jet-Melt, or other like compound in the same manner as the apertures 56 and 60 of the plug 18. FIG. 3 also shows an upper rear cavity section 66 for slidably receiving the internally configured terminals (shown in FIG. 4) therein, and a partitioning member 68 for separating the terminals.

Referring now to FIG. 4, a perspective, exploded, fragmentary view of the connector assembly 10 is illustrated showing more clearly the internal construction of the connector assembly 10, and particularly the receptacle 22. As can be seen, the male plug 18 further incorporates a plurality of outwardly protruding sections 74, 76 and 78 through which apertures 56, 58 and 60 pass, with the outermost sections 74 and 78 having a U-shaped cross-section. The protruding sections 74, 76 and 78 are operable to slidably enter a plurality of female, correspondingly shaped passages 80, 82 and 84 of the receptacle 22 in a mating fashion. The U-shape configuration of outer sections 80 and 84 form a key-like arrangement with protruding sections 74 and 78 to polarize the plug 18 to prevent it from accidentally being inserted upside down or otherwise incorrectly into the receptacle 22. The plug 18 is commercially available from the AMP Corporation of Harrisburg, Penna. as part number 1.480700-0.

Also shown more clearly in FIG. 4 is the manner in which the plug 18 and strain relief member 30 slidably and removably insert into first and second cavity portions 86 and 88 respectively of the receptacle 22. Also, the formed metal terminal socket members 90 and 92 which operate to receive metal terminal blades 94 and 96 respectively of the fuse 20 are illustrated. The fuse itself is a widely commercially available automotive-type fuse available from the Littlefuse Corporation of Des Plaines. IA, in a variety of current carrying capacities. The preferred embodiment, however, will incorporate a fuse 20 capable of handling from about one to twenty amps.

Although the connector assembly 10 has been described and illustrated as incorporating a removable fuse 20, it should be appreciated that incorporating a fuse is optional, and in some applications a fuse may not be needed. If the fuse 20 is not included, the overall height of the connector assembly 10 will be reduced accordingly, making the connector assembly 10 even more compact for applications where the minimum physical size of the connector assembly 10 is critical. It should also be appreciated that if no fuse 20 is incorporated, jumper wire 114 is not needed, and a direct connection may be made between terminal socket member 90 and the first portion 36 of electrical heating wire 40.

A fuse link 97, designed to open up when current passing therethrough exceeds a predetermined value, is also shown in FIG. 4 phantom electrically connecting blades 94 and 96. The terminal sockets 90 and 92 further have raised, biased locking tab elements 98 and 100 and biased, tongue-like contacts 102 and 104, the functions of which will be described in detail shortly. The terminal sockets 90 and 92 are commercially available from the Packard Electric Division, General Motors Corporation, Warren, Ohio, under part number 12015869. Metal terminal posts 106 and 108 having base portions 110 and 112 respectively, also commercially available from the AMP Corporation as part number 350-706-2, are also shown in the receptacle 22. Socket members 111 and 113 are available from the AMP Corporation as part number 350-689-2. Posts 106 and 108 engage mating female terminal portions socket members 111 and 113, shown in phantom within the protruding sections 74 and 78 when the plug 18 is engaged with the receptacle 22.

The overall connector assembly 10 will preferably be relatively small and compact, preferably about one and one-half inches in length, one inch in width, and one-half inch in height. Although the connector 10 may be manufactured such that its overall size may vary widely, for attaching to a heated garment, the above-mentioned dimensions provide a particularly desirable size connector 10 which is relatively unobtrusive and yet provides for easy manual articulation of the components thereof by a wearer of the garment 16.

FIG. 4 also illustrates that the sewing wings 28 may be double stitched to the fabric 14 of the garment 18 to hold the connector assembly 10 even more securely against the garment fabric 14. In addition, a wide variety of stitching patterns may be employed, and the simplified stitching pattern (shown most clearly in FIGS. 1 and 4) is only one example of a wide variety of stitching patterns that may be employed by those skilled in the art.

From FIG. 4 it can also be seen how the current will flow through the connector assembly 10. Current will enter through wire 32 and socket member 111 to terminal post 106. It then will travel through a copper or other suitable jumper wire 114 up to terminal socket 90. The jumper wire 114 is shown crimped to the ends of the terminal socket 90 and post 106, although it should be understood that the jumper wire 114 could just as easily be soldered or attached by other conventional means to electrically connect the terminal socket 90 and the terminal post 106. From the terminal socket 90 the current will then enter blade 94 of the fuse 20 when the fuse 20 is slidably and securely engaged in the first cavity portion 86 of the receptacle 22. The current will travel through the fuse link 97 of the fuse 20 and exit terminal blade 96 where it will enter terminal socket 92. From terminal socket 92 the current will flow through first portion 36 of the electrical heating wire 40, which is crimped or soldered, or both, onto a lug of terminal socket 92. The current will travel out through the heating wire 40 and return through the second portion 38 of the wire 40 which is crimped or soldered to terminal post 108. The current will then exit through a mating female terminal socket 113 disposed securely within protruding section 78 of the plug 18, to wire 34.

FIG. 4 also shows more clearly shoulder 44 of the receptacle 22 which is operable to lockably engage with locking tab 42 of the plug 18. Likewise, locking shoulder portion 48 of the strain relief member 30 and the cut-out 50 are also shown more clearly in FIG. 4.

Further shown in FIG. 4 is a plurality of beaded elements 116 and 118 attached to the first and second portions 36 and 38 of the heating wire 40. The beaded elements 116 and 118 operate cooperatively with the strain relief member 30 to help relieve the strain on terminal lug 92 and terminal post 108 when tension is placed on the heating wire 40 during wearing of the garment 16. The beaded elements may be of metal or plastic, and may be of any conventional or suitable design. Alternatively, instead of using beads, the wires 36 and 38 may be individually knotted in the general location of the beads 116 and 118.

Figure 5:
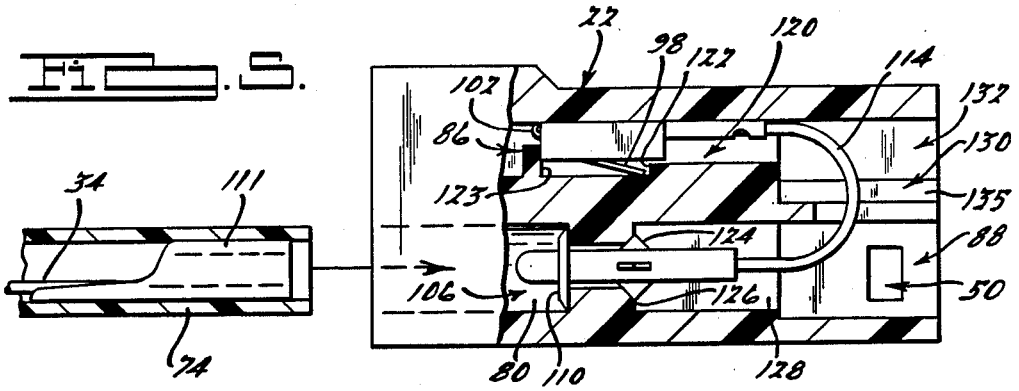
FIG. 5 is a side sectional view in partial cross-section of the female connector of the connector assembly to show more clearly the arrangement of apertured portions therein and one set of terminal lugs and terminal posts, and also showing part of the male connector.

Referring now to FIG. 5, there is shown a side sectional view of the receptacle 22 illustrating more clearly how terminal socket 90 and terminal post 106 are held securely within the receptacle 22. From FIG. 5 it can be seen that the terminal socket 90 is held securely within a cut-out section 120 of the receptacle 22 by a combination of action by its protruding locking tab 98 and interior shoulder portion 122. Locking tab 98 engages with interior shoulder portion 122 of the receptacle 22 after the terminal lug 90 is inserted in the cut-out section 120. Interior shoulder portion 123 further helps hold terminal socket 90 within cut-out area 120 by preventing it from being drawn or pulled out through first cavity portion 86.

FIG. 5 also shows how the terminal post 106 is secured within the receptacle 22. A plurality of tangs 124, which may be six in number, are designed to catch interior shoulder areas 126 of cut-out section 128 when the terminal post 106 is inserted through aperture 80 of the receptacle 22 into cut-out section 128. The base portion 110 of the terminal post 106 also prevents the post 106 from being pulled out towards the rear 26 of the receptacle 22. From FIG. 5 it can also be seen that a channel 130 exists in wall portion 135 of the receptacle 22 to allow the jumper wire 114 to connect terminal lug 90 and terminal post 106. Also shown more clearly is an upper rear cavity portion 132 for helping facilitate routing of the first portion 36 of the heating wire 40.

Figure 6:
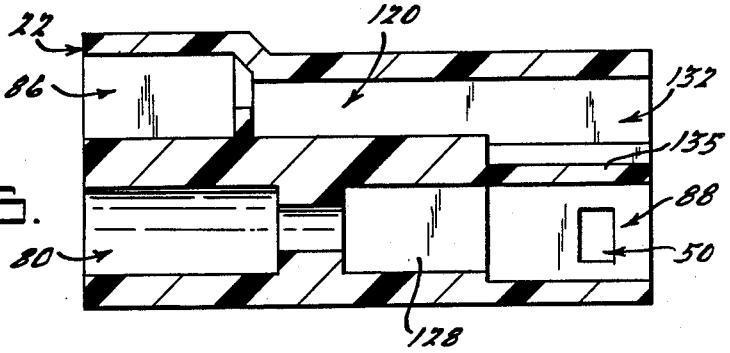
FIG. 6 is a side sectional view of the female connector taken along line 6—6 of FIG. 2 further illustrating the apertured portions and the first and second cavity portions thereof.
Figure 7:
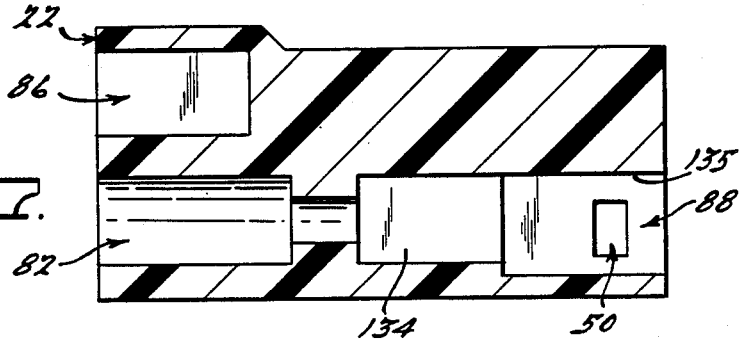
FIG. 7 is a side sectional view of the female connector housing, taken along line 7—7 of FIG. 2 showing more clearly the central apertured portion, together with the first and second cavity portions thereof.
Figure 8:
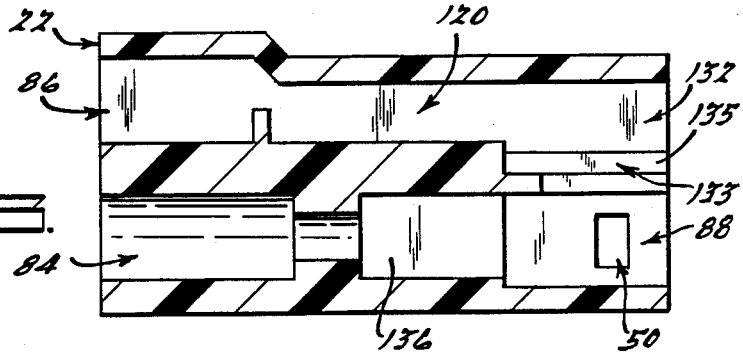
FIG. 8 is a side sectional view of the connector taken along line 8—8 of FIG. 2 showing more clearly the apertured portions and rear cavity portion of the female connector housing.

In FIGS. 6, 7 and 8, there are shown views along section lines 6—6, 7—7 and 8—8 respectively of the receptacle 22 of FIG. 2. As may be best seen in FIGS. 3 and 8, a second channel 133 like channel 130 shown in FIG. 5 also is provided in wall portion 135 for allowing wire portion 36 to pass from the lower chamber 88 to the upper chamber 132. FIGS. 6—8 also all illustrate in various detail the apertures and cavities of the receptacle 22. FIG. 7 illustrates aperture 82 and its associated cut-out portion 134. Although aperture 82 is not used in the preferred embodiment, it has been included to allow for any future wiring changes and/or additions within the connector assembly 10. FIG. 8 illustrates aperture 84 and its associated cut-out portion 136.

The present invention is thus well calculated to provide a small size, fused, electrical connector assembly capable of being quickly and easily attached by sewing or the like to the fabric of an electrically heated garment. The present invention provides the added advantages and benefits of relatively simple and inexpensive construction, thereby further enhancing its commercial appeal and practicability.

Although the present invention has been discussed in connection with particular examples and illustrations thereof, it should be appreciated that the present invention may also be adapted for use in a wide variety of other applications, such as sleeping bags, blankets, or virtually any other application where it is desired to attach an electrical connector assembly to a fabric, by those skilled in the art with little or no variations thereof, and without departing from the true and fair scope of the following claims.

What is claimed is:

1. For an electrically heated garment, an electrical connector assembly adapted to be securely attached to a portion of fabric of the garment for allowing electric current to be supplied through the connector assembly to a heating wire of the garment, the connector assembly comprising:

a removable male plug having first and second ends and at least one elongated aperture for allowing at least one conductor to reside at least partially therein;

a female receptacle having front and rear portions, the front portion of the female receptacle having at least one elongated aperture for allowing the male plug to at least partially reside therein, and the rear portion being configured to partially house therein a portion of the heating wire, the female receptacle further being configured to matingly engage with the male plug to thereby electrically connect the conductor and the heating wire in series;

a removable fuse slidably disposed in the front portion of the female receptacle, and being in series with the conductor and the portion of the heating wire;

at least one relatively flat and thin wing integrally formed with the female receptacle and protruding outwardly therefrom, the wing being adapted to be easily sewn to the fabric of the garment to thereby hold the female receptacle securely against the garment; and a strain relief member having at least one aperture therethrough for allowing passage therethrough of the portion of the heating wire, the strain relief member being operable to slidably engage with the female receptacle to help relieve strain on the connector assembly when the heating wire is under tension.

2. The connector assembly of claim 1, wherein the connector assembly further comprises at least one electrical terminal lug securely held therein and adapted to releasably and electrically connect with the fuse.

3. The connector assembly of claim 1, further comprising:

at least one terminal post securely disposed within a portion of the aperture of the female receptacle;

at least one electrical terminal sleeve disposed within the aperture of the plug; and wherein the terminal post is operable to releasably connect with the electrical terminal sleeve to form an electrical connection for connecting the conductor and the heating wire.

4. The system of claim 1, further including a jumper wire for electrically connecting the fuse in series with the conductor and the heating wire.

5. For an electrically heated garment made at least in part of fabric, an electrical connector assembly adapted to be securely attached to a portion of the fabric of the garment for allowing electric current to be supplied through the connector assembly to at least one heating wire of the garment, the connector assembly comprising:

removable male plug means having first and second terminal portions for securely receiving portions of first and second conductors;

receptacle means for securely receiving a portion of at least one heating wire and removably receiving the plug means in a mating fashion, whereby receipt of the plug means in the receptacle means operates to electrically connect the first conductor to the heating wire, thereby allowing electrical current to flow through the heating wire;

a readily removable and replaceable fuse adapted to reside in series with the first conductor and the heating wire;

means included in the receptacle means for removably receiving the fuse;

thin and substantially flat wing means securely attached to the receptacle means and protruding outwardly therefrom for facilitating secure attachment of the receptacle means to the fabric of the garment; and means attachable to the receptacle means, for helping to relieve strain on the heating wire.

6. The connector assembly of claim 5, wherein the means for removably receiving the fuse comprises a first cavity section having at least first and second apertured portions therethrough, the cavity section further being integrally formed with the receptacle means and adapted to facilitate sliding receipt of the fuse therein.

7. The connector assembly of claim 5, wherein the wing means include a plurality of substantially planar wing portions extending outwardly from the receptacle means and integrally formed therewith, the wing portions being arranged to facilitate attachment of the receptacle means to the garment.

8. The connector assembly of claim 7, wherein the wing portions are sufficiently thin to be readily attached to the fabric of the garment by sewing thread.

9. The connector assembly of claim 6, wherein the receptacle means further comprises a second cavity section for removably receiving in a sliding fashion the means for helping to relieve strain.

10. The connector assembly of claim 5, wherein the connector assembly further comprises:

at least one locking shoulder portion protruding outwardly from an outer surface of the receptacle means; and at least one locking tab protruding outwardly from an outer surface of the plug means, the locking tab further being disposed so as to snappingly engage with the locking shoulder portion of the receptacle means when the plug means is connected to the receptacle means and the locking tab further being manually articulable to permit the locking tab to be manually disengaged from the locking shoulder portion to thereby allow the plug means to be disconnected from the receptacle means.

11. The connector assembly of claim 5, wherein the means for helping to relieve strain includes a removable member having at least one shoulder portion protruding outwardly therefrom, and wherein the receptacle means further includes a cut-out portion operable to lockably engage with the shoulder portion when the relieve strain on the removable member is slidably inserted into the receptacle means, thereby holding the means for helping to relieve strain securely in the receptacle means.

12. An electrical connector assembly, adapted to be securely attached to fabric, for allowing electrical current to be supplied from a first wire conductor through the connector assembly to a second wire conductor, the connector assembly comprising:

removable first connector means for securely receiving a portion of the first wire conductor;

second connector means for securely receiving a portion of the second wire conductor and removably connecting with the first connector means in a mating fashion, whereby mating connection of the first and second connector means operates to electrically connect the first and second wire conductors, thereby allowing current to flow through to the second wire conductor;

wing means of thin and substantially planar configuration securely attached to the second connector means and protruding outwardly therefrom for facilitating secure attachment of the second connector means to the fabric, a readily removable and replaceable fuse adapted to reside in series with and between the first and second wire conductors; and means, located in and forming part of one of the connector means, for removably receiving the fuse, whereby the fuse operates to interrupt the current flowing through the first and second wire conductors when more than a predetermined amount of current flows in the wire conductors.

13. The connector assembly of claim 12, wherein the means for removably receiving the fuse includes a cavity section provided with walls integrally formed with the second connector means, the walls defining a cavity sized to slidably and removably receive the fuse therein.

14. The connector assembly of claim 12 in which the fabric is part of a garment, and wherein the wing means include at least one relatively thin and flat portion integrally formed with the second connector means, the flat portion protruding outwardly from the second connector means to facilitate easy attachment of the wing means to the garment.

15. The connector assembly of claim 14, wherein the flat portion is sufficiently thin to enable the wing means to be sewn to the garment.

16. The connector assembly of claim 12, wherein the first connector means receives portions of at least two conductors and includes means for relieving strain imposed upon the received portions of the two conductors.

* * * * *